US010746446B2

(12) United States Patent
Gokhale et al.

(10) Patent No.: US 10,746,446 B2
(45) Date of Patent: Aug. 18, 2020

(54) INTELLIGENT DEFROST CONTROL METHOD

(71) Applicant: Lennox Industries Inc., Richardson, TX (US)

(72) Inventors: Umesh Gokhale, Irving, TX (US); Jon Douglas, Lewisville, TX (US); Eric Berg, The Colony, TX (US)

(73) Assignee: Lennox Industries Inc., Richardson, TX (US)

( * ) Notice: Subject to any disclaimer, the term of this patent is extended or adjusted under 35 U.S.C. 154(b) by 112 days.

(21) Appl. No.: 15/384,824

(22) Filed: Dec. 20, 2016

(65) Prior Publication Data

US 2017/0176072 A1 Jun. 22, 2017

Related U.S. Application Data

(60) Provisional application No. 62/270,235, filed on Dec. 21, 2015.

(51) Int. Cl.
*F25B 47/02* (2006.01)
*F25B 49/00* (2006.01)

(52) U.S. Cl.
CPC ..... *F25B 47/025* (2013.01); *F25B 49/00* (2013.01); *F25B 2500/19* (2013.01);
(Continued)

(58) Field of Classification Search
CPC ..... F25B 47/025; F25B 47/02; F25B 47/022; F25B 47/027; F25B 49/00;
(Continued)

(56) References Cited

U.S. PATENT DOCUMENTS 3,077,747 A * 2/1963 Johnson, Jr. ..... F25B 47/022 62/140
4,852,360 A * 8/1989 Harshbarger, Jr. ... F25B 47/025 62/156

(Continued)

FOREIGN PATENT DOCUMENTS

DE 3212460 A1 * 10/1983 ..... F25D 21/02

OTHER PUBLICATIONS

Partial English Machine Translation: DE 3212460. Accessed Jun. 2018.*

(Continued)

*Primary Examiner* — Tavia Sullens
(74) *Attorney, Agent, or Firm* — Winstead PC

(57) ABSTRACT

A method of initiating a defrost cycle using a controller of a heat pump system includes measuring a temperature of an evaporator coil and determining whether the temperature of the evaporator coil is less than a freezing temperature. Responsive to a determination that the temperature of the evaporator coil is less than the freezing temperature, determining whether a current dew point temperature of air is greater than the temperature of the evaporator coil. Responsive to a determination that the current dew point temperature of air is greater than the temperature of the evaporator coil, calculating a frost-collection rate. Determining whether the frost-collection rate is greater than a frost-collection-rate threshold, and, responsive to a determination that the frost-collection rate is greater than the frost-collection-rate threshold, initiating a defrost cycle.

23 Claims, 3 Drawing Sheets

(52) U.S. Cl.
CPC ..... *F25B 2500/31* (2013.01); *F25B 2700/02* (2013.01); *F25B 2700/11* (2013.01); *F25B 2700/2106* (2013.01); *F25B 2700/2117* (2013.01)

(58) Field of Classification Search
CPC ..... F25B 2341/0662; F25B 2500/19; F25B 2500/31; F25B 2700/02; F25B 2700/11; F25B 2700/2106; F25B 2700/2117; F25B 2347/00; F25B 2347/02; F25B 2347/021; F25B 2347/022; F25B 2347/023; F25B 2700/21171; F24F 11/41; F24F 11/42; F24F 11/43; F25D 21/00; F25D 21/002; F25D 21/004; F25D 21/006; F25D 21/008; F25D 21/03; F25D 21/025
See application file for complete search history.

(56) References Cited

U.S. PATENT DOCUMENTS 5,319,943 A * 6/1994 Bahel ..... F25D 21/006 62/156
2009/0205354 A1* 8/2009 Brown ..... F25B 47/025 62/324.5
2013/0291577 A1* 11/2013 Miyakoshi ..... B60H 1/00392 62/151
2015/0304406 A1* 10/2015 Penilla ..... G01C 21/26 709/203

OTHER PUBLICATIONS

"Heating and Cooling with a Heat Pump". Natural Resources Canada's Office of Energy Efficiency. Rev. Dec. 2004.*
"Electric Lock Out on Heat Pumps". Washington State University Extension Energy Program. Apr. 2010.*
"Your Guide to Total Economical Comfort: Heat Pump Systems". Lennox. No Date.*
Zhu, Jiahe, et al.; "A Novel Temperature—Humidity—Time Defrosting Control Method Based on a Frosting Map for Air-Source Heat Pumps"; International Journal of Refrigeration, vol. 54; Feb. 20, 2015; pp. 45-54.

* cited by examiner

INTELLIGENT DEFROST CONTROL METHOD

CROSS-REFERENCE TO RELATED APPLICATIONS

This application claims priority to and incorporates by reference the entire disclosure of U.S. Provisional Patent Application No. 62/270,235, which was filed on Dec. 21, 2015.

TECHNICAL FIELD

The present invention relates generally to heat pump systems and more particularly, but not by way of limitation, to a method for controlling a defrost cycle of a heat pump system.

BACKGROUND

In a heat pump system running in a heating mode, it is common for frost to form on an exterior coil of the heat pump system. While the heat pump system is operating in the heating mode, the exterior coil can become extremely cool as the heat pump system attempts to transfer heat from exterior ambient air to a refrigerant in the exterior coil. If a temperature of the exterior coil cools to a temperature below a dew point temperature of the exterior ambient air, condensation occurs on the exterior coil. If the temperature of the exterior coil drops to a temperature below freezing or the exterior ambient air is below freezing, the condensation will turn into frost on the exterior coil. Formation of frost on the exterior coil is common in most areas where heat pump systems are used.

The formation of frost on the exterior coil reduces the effectiveness of the exterior coil as a heat transfer unit. The exterior coil is designed to transfer heat from the exterior ambient air to the refrigerant inside the exterior coil. To achieve this function, an exterior fan is typically used to draw exterior ambient air across the exterior coil. When frost forms on the exterior coil, an ability of the exterior fan to draw air across the exterior coil is reduced, which reduces the exterior coil's ability to absorb heat from the exterior ambient air.

Methods have been developed to defrost the exterior coil to remove frost that has built up on the exterior coil. One defrost method involves switching the heat pump system into a defrost mode during which the heat pump system operates as an air conditioner to transfer heat from the interior of an enclosed space, such as, for example, a house, to the exterior coil to melt any frost that has formed thereon. The heat pump system then operates as a typical air conditioner to transfer heat from the interior of the house to the exterior coil via a compressor and expansion valve system. In the defrost mode, the refrigerant in the exterior coil becomes warmer such that frost that has formed on the exterior coil melts. Meanwhile, the refrigerant in the interior coil becomes cooler. Interior air that is passed over the cooled interior coil blows out into the heated space. This is known in the industry as "cold blow." Cold blow is typically counteracted with auxiliary heating elements.

When the heat pump system initiates a defrost cycle to remove frost from the exterior coil, three events typically occur: 1) the exterior fan is deactivated; 2) a reversing valve shifts from the heating mode to the defrost mode; and 3) the auxiliary heating elements are activated. The exterior fan is deactivated to stop the cooling effect on the frost formed on the exterior coil and to allow the frost to melt. The reversing valve is shifted to reverse the flow of the refrigerant within the heat pump system to provide hot refrigerant to the exterior coil to melt the frost. The auxiliary heating elements are activated to heat the interior air that is blown over the cool interior coil and into the interior of the building in order to provide warm air.

SUMMARY

A controller for initiating a defrost cycle of a heat pump system is configured to measure a temperature of an evaporator coil and to determine if the temperature of the evaporator coil is less than a freezing temperature. Responsive to a determination that the temperature of the evaporator coil is less than the freezing temperature, the controller is configured to determine if a current dew point temperature of air is greater than the temperature of the evaporator coil. Responsive to a determination that the current dew point temperature of air is greater than the temperature of the evaporator coil, the controller is configured to calculate a frost-collection rate. Responsive to a determination that the frost-collection rate is greater than a frost-collection-rate threshold, the controller is configured to initiate a defrost cycle.

A method of initiating a defrost cycle using a controller of a heat pump system includes measuring a temperature of an evaporator coil and determining whether the temperature of the evaporator coil is less than a freezing temperature. Responsive to a determination that the temperature of the evaporator coil is less than the freezing temperature, determining whether a current dew point temperature of air is greater than the temperature of the evaporator coil. Responsive to a determination that the current dew point temperature of air is greater than the temperature of the evaporator coil, calculating a frost-collection rate. Determining whether the frost-collection rate is greater than a frost-collection-rate threshold, and, responsive to a determination that the frost-collection rate is greater than the frost-collection-rate threshold, initiating a defrost cycle.

BRIEF DESCRIPTION OF THE DRAWINGS

For a more complete understanding of the present invention and for further objects and advantages thereof, reference may now be had to the following description taken in conjunction with the accompanying drawings in which.

DETAILED DESCRIPTION

Figure 1:
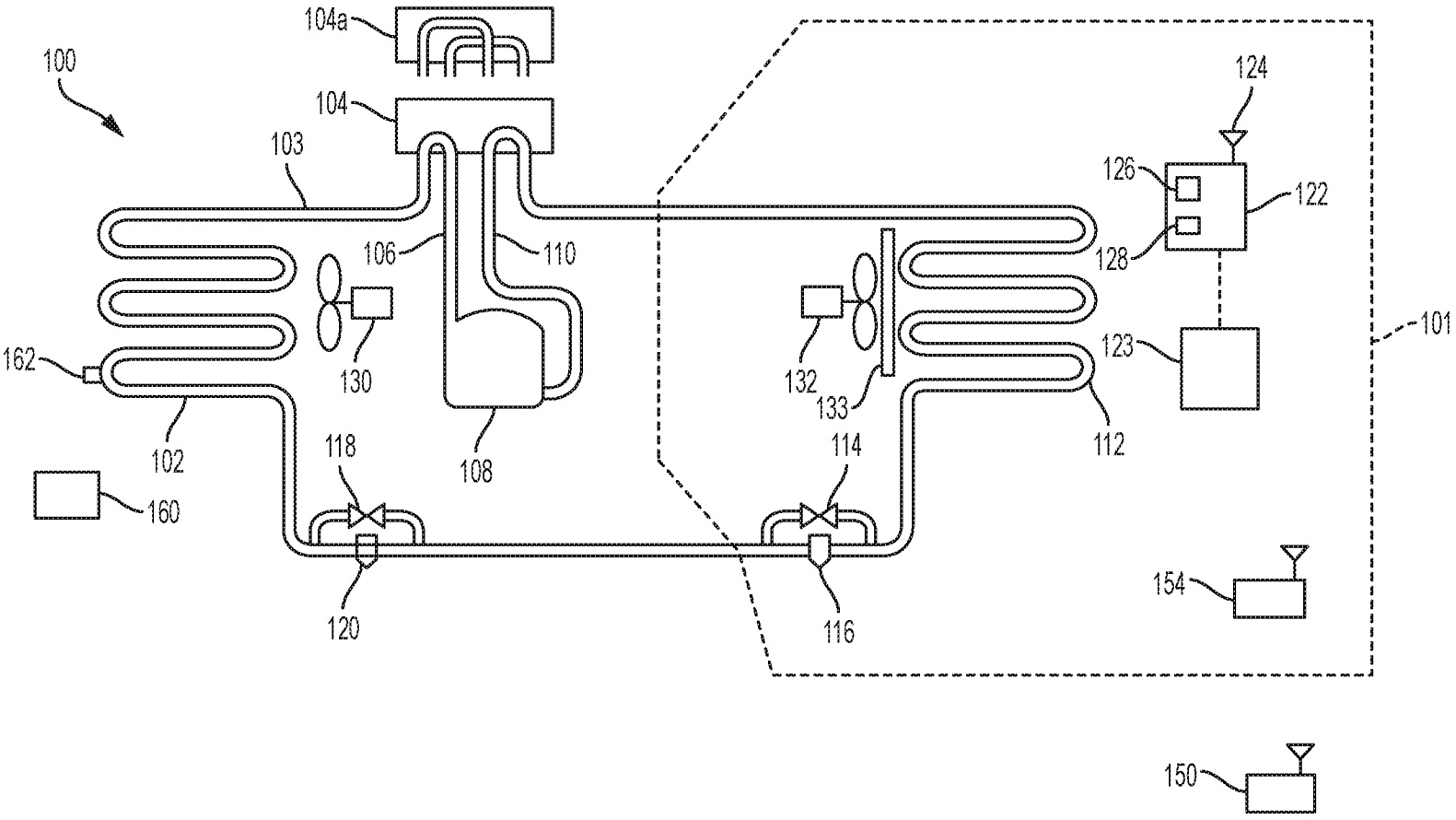
FIG. 1 is a schematic diagram of an illustrative heat pump system.

Various embodiments of the present invention will now be described more fully with reference to the accompanying drawings. The invention may, however, be embodied in many different forms and should not be construed as limited to the embodiments set forth herein.

Prior heat pump systems have incorporated defrost-cycle algorithms based on one or both of condenser-coil temperature and time since a most-recent defrost cycle. However, these algorithms are often inefficient and unreliable because they fail to consider environmental humidity and temperature conditions. For example, it is possible for heat pump systems to operate in environmental conditions where the ambient air temperature is below freezing but the exterior coil temperature is above the dew point. In such conditions, no condensation will form on the exterior coil and no defrost cycle is necessary. If the heat pump system uses a defrost algorithm that does not consider the environmental humidity and temperature conditions, an unnecessary defrost cycle may be initiated due to the exterior temperature being below freezing. Running unnecessary defrost cycles is a waste of energy and also prevents the heat pump system from operating as a heat pump to provide heat to the interior space because, during the defrost cycle, the heat pump system operates as an air conditioner to provide warm refrigerant to the evaporator coil.

Heat pump systems typically include an exterior coil that operates as an evaporator coil and an interior coil that operates as a condenser coil. A person having skill in the art will appreciate that when the heat pump systems operate in the defrost mode, the outdoor coil operates as a condenser coil and the indoor coil operates as evaporator coil. For the purposes of this application, the term "evaporator coil" is used to refer to the exterior coil and the term "condenser coil" is used refer the interior coil irrespective of the operating mode being described unless specifically stated otherwise.

During operation of the heat pump system, if the temperature of the evaporator coil drops below the dew point temperature, water may begin to condense from the ambient air that surrounds the evaporator coil onto the evaporator coil. If the evaporator coil temperature is below freezing, the condensed water freezes to form frost on the evaporator coil. For the heat pump system to operate efficiently, the heat pump system includes a defrost control to periodically initiate a defrost cycle to melt the frost that has accumulated on the evaporator coil.

The rate at which frost forms on the evaporator coil is referred to as a frosting rate. The frosting rate is a function of environmental temperature and humidity. In a typical embodiment, and in contrast to prior defrost-cycle algorithms, the illustrative defrosting method utilizes local environmental humidity and temperature data to determine when a defrost cycle is necessary.

In some embodiments, the environmental humidity and temperature data are provided to the heat pump system via, for example, a weather-data service. For example, information from the weather-data service may be obtained by a system controller of the heat pump system via an internet connection. The weather-data service may provide the environmental humidity and temperature data, for example, periodically (e.g., every hour, etc.) or on a "push" basis (e.g., the weather-data service provides updates to the heat pump system whenever the data changes). In some embodiments, the environmental humidity and temperature data may be obtained with one or more sensors, such as, for example, temperature and humidity sensors that are positioned proximal to the evaporator coil. Utilizing the environmental humidity and temperature data enables the heat pump system to more accurately determine if the defrost mode should be initiated.

Referring now to FIG. 1, a schematic diagram of an illustrative heat pump system 100 is shown. The heat pump system 100 includes an evaporator coil 102, a reversing valve 104, a compressor 108, and a condenser coil 112 that are coupled together to form a circuit through which a refrigerant may flow. The heat pump system 100 also includes a controller 122 that controls the operation of the components within the heat pump system 100. In a typical embodiment, the controller 122 comprises a computer that includes components for controlling and monitoring the heat pump system 100. For example, the controller 122 comprises a CPU 126 and memory 128. In a typical embodiment, the controller 122 is in communication with a thermostat 123 that allows a user to input a desired temperature for the enclosed space 101. The controller 122 may be an integrated controller or a distributed controller that directs operation of the heat pump system 100. In a typical embodiment, the controller 122 includes an interface to receive, for example, thermostat calls, temperature setpoints, blower control signals, environmental conditions, and operating mode status for the heat pump system 100. For example, in a typical embodiment, the environmental conditions may include indoor temperature and relative humidity of the enclosed space 101 (shown in FIG. 1).

The refrigerant flows through the heat pump system 100 in a continuous heating cycle. Starting from the evaporator coil 102, an outlet 103 of the evaporator coil 102 is coupled to a suction line 106 of the compressor 108 via the reversing valve 104 to feed the refrigerant to the compressor 108. The compressor 108 compresses the refrigerant. A discharge line 110 feeds compressed refrigerant from the compressor 108 through the reversing valve 104 to the condenser coil 112. In the heat pump configuration, refrigerant traveling from the condenser coil 112 flows through a first bypass valve 114, avoiding a first throttling valve 116 that is in the closed position, and is directed to the evaporator coil 102. Just before the refrigerant enters the evaporator coil 102, the refrigerant passes through a second throttling valve 120, avoiding a second bypass valve 118 that is in a closed position. The second throttling valve 120 reduces a pressure of the refrigerant as it enters the evaporator coil 102 and the heating cycle begins again. The behavior of the refrigerant as it flows through the heat pump system 100 is discussed in more detail below.

During operation of the heat pump system 100, low-pressure, low-temperature refrigerant is circulated through the evaporator coil 102. The refrigerant is initially in a liquid/vapor state. In a typical embodiment, the refrigerant is, for example, R-22, R-134a, R-410A, R-744, or any other suitable type of refrigerant as dictated by design requirements. Ambient air from the environment surrounding the evaporator coil 102, which is typically warmer than the refrigerant in the evaporator coil, is circulated around the evaporator coil 102 by an exterior fan 130. In a typical embodiment, the refrigerant begins to boil after absorbing heat from the ambient air and changes state to a low-pressure, low-temperature, super-heated vapor refrigerant. Saturated vapor, saturated liquid, and saturated fluid refer to a thermodynamic state where a liquid and its vapor exist in approximate equilibrium with each other. Super-heated fluid and super-heated vapor refer to a thermodynamic state where a vapor is heated above a saturation temperature of the vapor. Sub-cooled fluid and sub-cooled liquid refers to a thermodynamic state where a liquid is cooled below the saturation temperature of the liquid.

The low-pressure, low-temperature, super-heated vapor refrigerant leaving the evaporator coil 102 is fed into the reversing valve 104 that, in the heat pump mode, directs the refrigerant into the compressor 108 via the suction line 106. In a typical embodiment, the compressor 108 increases the pressure of the low-pressure, low-temperature, super-heated vapor refrigerant and, by operation of the ideal gas law, also increases the temperature of the low-pressure, low-temperature, super-heated vapor refrigerant to form a high-pressure, high-temperature, superheated vapor refrigerant. The high-pressure, high-temperature, superheated vapor refrigerant leaves the compressor 108 via the discharge line 110 and enters the reversing valve 104 that, in the heat pump mode, directs the refrigerant to the condenser coil 112.

Air from the enclosed space 101 is circulated around the condenser coil 112 by an interior fan 132. The air from the enclosed space 101 is typically cooler than the high-pressure, high-temperature, superheated vapor refrigerant present in the condenser coil 112. Thus, heat is transferred from the high-pressure, high-temperature, superheated vapor refrigerant to the air from the enclosed space 101. Removal of heat from the high-pressure, high-temperature, superheated vapor refrigerant causes the high-pressure, high-temperature, superheated vapor refrigerant to condense and change from a vapor state to a high-pressure, high-temperature, sub-cooled liquid state. The high-pressure, high-temperature, sub-cooled liquid refrigerant leaves the condenser coil 112 and passes through the first bypass valve 114. The first throttling valve 116 is in the closed position while the heat pump system operates as a heat pump. Just before the high-pressure, high-temperature, sub-cooled liquid refrigerant enters the evaporator coil 102, the high-pressure, high-temperature, sub-cooled liquid refrigerant passes through the second throttling valve 120.

The second throttling valve 120 abruptly reduces the pressure of the high-pressure, high-temperature, sub-cooled liquid refrigerant and regulates an amount of refrigerant that travels to the evaporator coil 102. Abrupt reduction of the pressure of the high-pressure, high-temperature, sub-cooled liquid refrigerant causes sudden, rapid, evaporation of a portion of the high-pressure, high-temperature, sub-cooled liquid refrigerant, commonly known as "flash evaporation." The flash evaporation lowers the temperature of the resulting liquid/vapor refrigerant mixture to a temperature lower than a temperature of the ambient air. The liquid/vapor refrigerant mixture leaves the second throttling valve 120 and returns to the evaporator coil 102, and the cycle begins again. This cycle continues as needed or until the heat pump system 100 determines that a defrost cycle needs to be run to remove frost that has built up on the evaporator coil 102.

As shown in FIG. 1, the heat pump system 100 is operating as a heat pump to provide heat to the enclosed space 101. However, in order to defrost the evaporator coil 102, the heat pump system 100 is configured to operate in the defrost mode. To initiate the defrost mode, the controller 122 reverses the flow of the refrigerant through the heat pump system 100 to cause the evaporator coil 102 to act as a condenser coil and to cause the condenser coil 112 to act as an evaporator coil. Repurposing the evaporator coil to act as a condenser coil causes the temperature of the evaporator coil 102 to increase, thereby melting any frost that has accumulated on the evaporator coil 102. To operate the heat pump system 100 in the defrost mode, the controller 122: 1) switches the reversing valve 104 to the valve configuration illustrated as reversing valve 104*a* to reverse the flow direction of the refrigerant through the heat pump system 100; 2) closes the first bypass valve 114 and opens the first throttling valve 116; and 3) closes the second throttling valve 120 and opens the second bypass valve 118. So configured, the heat pump system 100 provides warm refrigerant to the evaporator coil 102 to melt frost from the evaporator coil 102. However, with the condenser coil 112 operating as an evaporator coil, the air blown over the condenser coil 112 by the interior fan 132 is cooled by the condenser coil 112, which now has cold refrigerant passing therethrough. To counter this cooling effect, a heating element 133 is activated to warm the air. In a typical embodiment, the heating element 133 is a resistive heating element. In other embodiments, the heating element 133 may comprise other devices that permit air passing around the heating element 133 to be warmed.

In a typical embodiment, the controller 122 is configured to communicate with the components of the heat pump system 100 to monitor and control the components of the heat pump system 100. Communication between the controller 122 and the components of the heat pump system 100 may be via a wired or a wireless connection. In a typical embodiment, the controller 122 is configured to control operation of one or more of the reversing valve 104, the compressor 108, the first bypass valve 114, the first throttling valve 116, the second bypass valve 118, the second throttling valve 120, the exterior fan 130, the interior fan 132, and the heating element 133. The heating element 133 is used during the defrost cycle to heat air from the enclosed space 101 that is blown over the condenser coil 112 by the interior fan 132. The controller 122 controls whether the reversing valve 104 is in the heat pump mode or the defrost mode. The controller 122 also controls whether or not the compressor 108 is operating. In some embodiments, the compressor 108 may be a variable or multispeed compressor. In such embodiments, the controller 122 controls the speed at which the compressor 108 operates. The controller 122 also controls whether the first bypass valve 114, the first throttling valve 116, the second bypass valve 118, the second throttling valve 120, are in the open or closed position. The controller 122 also controls the whether the exterior fan 130 and the interior fan 132 are operating. In some embodiments, one or both of the exterior fan 130 and the interior fan 132 may be variable or multispeed fans. In such embodiments, the controller 122 controls the speed at which the exterior fan 130 and the interior fan 132 operate.

In a typical embodiment, the controller 122 can communicate with an external data source 150 via an antenna 124. In some embodiments, the controller 122 may use the antenna 124 to communicate with a router 154. The router 154 may be, for example, an internet access point that is connected to the Internet. The external data source 150 provides data regarding local environmental conditions to the controller 122 and may be, for example, an internet weather-data service. In a typical embodiment, the data from the external data source 150 may include: temperature, humidity, dew point temperature, forecast information, and the like. Forecast information can include predictions about future temperature, humidity, dew point temperature, and the like. In some embodiments, the controller 122 can monitor the temperature of the evaporator coil 102 and humidity data from a first sensor 160 that positioned proximal to the evaporator coil 102. In some embodiments, additional environmental data may be measured with a second sensor 162 positioned proximal to the evaporator coil 102. In some embodiments, the first sensor 160 and the second sensor 162 may include multiple sensors to monitor multiple aspects of the environmental conditions, such as, for example, humidity and temperature of an area in proximity to the evaporator coil 102.

In some embodiments, the controller 122 calculates the dew point temperature using temperature and relative humidity data provided by the external data source 150. The controller 122 may use some or all of the data from the external data source 150 to determine if a defrost cycle should be initiated. Use of data from the external data source 150 to initiate a defrost cycle will be discussed in more detail below. In some embodiments, the controller 122 calculates the dew point temperature using temperature and relative humidity data provided by at least one of the first sensor 160 and the second sensor 162.

In some embodiments, the controller 122 may rely upon, in part or in whole, on data obtained from one or more components of the heat pump system 100 to determine if a defrost cycle should be initiated. For example, the controller 122 may monitor the power consumption of the exterior fan 130. During normal operation, the controller 122 controls the exterior fan 130 to maintain a certain revolutions per minute (RPM) so that a certain cubic feet per minute (CFM) of air flows around the evaporator coil 102. In order to maintain that RPM, the exterior fan 130 consumes a certain amount of power. During operation of the heat pump system 100, the controller 122 can monitor either or both of the RPM and the power consumed by the exterior fan 130. When frost forms on the evaporator coil 102, flow of air around the evaporator coil 102 is inhibited. The reduction of air flow around the evaporator coil 102 causes the RPM of the exterior fan 130 to drop. In order to maintain the desired RPM, additional power is provided to the exterior fan 130. In response to the RPMs of the exterior fan 130 crossing an RPM threshold or the power consumption of the exterior fan 130 increasing beyond a power threshold, the controller 122 may initiate a defrost cycle. After the defrost cycle has been run, the controller 122 can confirm that the defrost cycle was successful in removing frost from the evaporator coil 102 by checking to see if the RPM or power consumption of the exterior fan 130 no longer exceeds the threshold value.

In some embodiments, the controller 122 can monitor a speed of the compressor 108 to determine the speed of the exterior fan 130. During operation of the heat pump system 100, the speed of the exterior fan 130 is related to the speed of the compressor 108. As frost begins to form on the evaporator coil 102, the ability for the heat pump system 100 to provide heat to the enclosed space 101 decreases. To combat the loss in heating performance, a speed of the compressor 108 is typically increased to provide additional heating capacity. As a result of increasing the compressor speed, the speed of the exterior fan 130 is also increased. Thus, the controller 122 can initiate a defrost cycle in response to a speed of the compressor 108 exceeding a threshold value.

Figure 2:
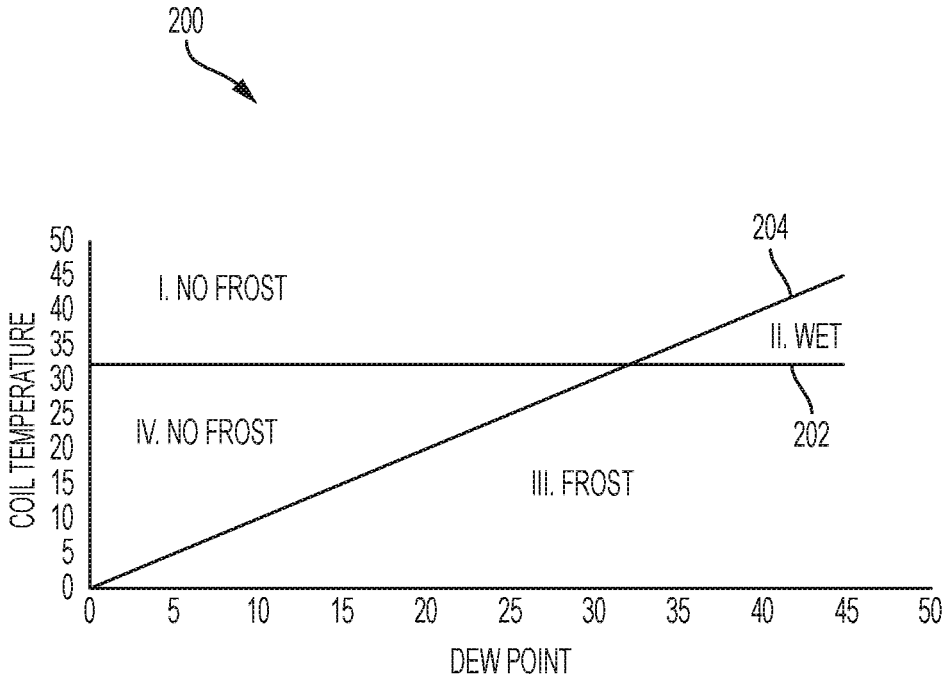
FIG. 2 is graph of a frost map.

Referring now to FIG. 2, a graph demonstrating a frost map 200 is shown. For illustrative purposes, the FIG. 2 will be described relative to the heat pump system 100 of FIG. 1. The frost map plots the temperature of the evaporator coil 102 versus dew point temperature. The term frost potential refers to the difference between dew-point temperature and the temperature of the evaporator coil 102. When the temperature of the evaporator coil 102 is greater (i.e., warmer) than the dew-point temperature or above freezing, the frost potential is negative. In other words, no frost can accumulate on the evaporator coil 102. Therefore, no defrost cycle is needed. In contrast, when the temperature of the evaporator coil 102 is less than (i.e., colder) than the dew-point temperature and is also at or below freezing, the frost potential is positive. In other words, frost collection on the evaporator coil 102 is possible. Therefore, a defrost cycle may be necessary.

A freeze line 202 identifies the freezing point of water for a given environment. For the purposes of FIG. 2, it is assumed that the freezing point of water is 32 ° F. It will be appreciated by a person of ordinary skill in the art that the freezing point of water may vary slightly based on environmental conditions, such as, for example, altitude. A dew point line 204 identifies conditions for which the formation of frost may occur. As illustrated in FIG. 2, the temperature of the evaporator coil 102 must be at or below freezing and below the dew-point temperature in order for frost to collect on the evaporator coil 102. If the temperature of the evaporator coil 102 is greater than freezing or at or above the dew-point temperature, frost cannot form on the evaporator coil 102.

The freeze line 202 and the dew point line 204 intersect and divide the frost map 200 into Regions I-IV. In Region I, the temperature of the evaporator coil 102 is above the freeze line 202 and above the dew point line 204. Thus, no condensation will form on the evaporator coil 102 and a defrost cycle does not need to be run. In Region II, the temperature of the evaporator coil 102 is above freeze line 202 and below the dew point line 204. Formation of condensation on the evaporator coil 102 will occur in Region II. However, because the temperature of the evaporator coil 102 is above the freeze line 202, no frost will form on the evaporator coil 102 and a defrost cycle does not need to be run. In Region III, the temperature of the evaporator coil 102 is below the freeze line 202 and below the dew point line 204. In Region III, frost can begin to form on the evaporator coil 102. When the heat pump operates in Region III, a defrost cycle will need to be run periodically to insure that too much frost does not build up on the evaporator coil 102. In Region IV, the temperature of the evaporator coil 102 is below the freeze line 202 and above the dew point line 204. No condensation or frost will form on the evaporator coil 102 while the heat pump operates in Region IV, thus a defrost cycle does not need to be run when the heat pump is operating within Region IV.

Figure 3:
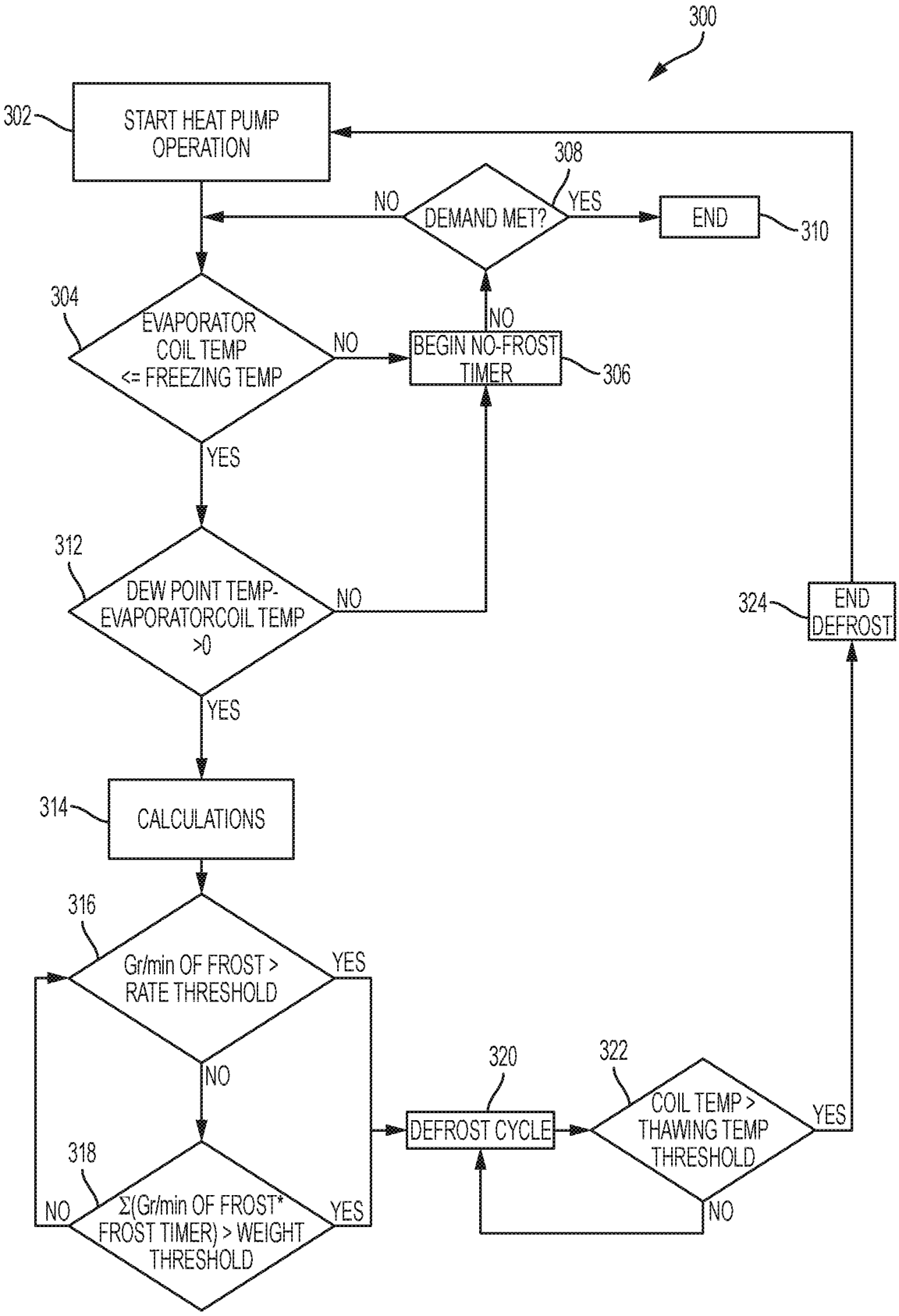
FIG. 3 is a flow diagram of an illustrative process for defrost control for a heat pump.

Referring now to FIG. 3, a flow diagram of an illustrative process 300 for defrost control for a heat pump is shown. For illustrative purposes, the process 300 will be described relative to the heat pump system 100 of FIG. 1. A person having skill in the art will recognize that the process 300 may be utilized by other systems for which a defrost cycle is used. The process 300 can be carried out by, for example, the controller 122. The process 300 begins at a step 302. At step 302, the heat pump system 100 begins to operate and a heating timer is initiated. The heating timer tracks the amount of time the heat pump system 100 has been in operation. After the heat pump system 100 has begun operating, the process 300 proceeds to step 304.

At step 304, the controller 122 determines whether a temperature of the evaporator coil 102 is below the freeze temperature. The temperature of the evaporator coil 102 may be obtained via the first sensor 160 or may be determined by measuring the temperature of the refrigerant passing through the evaporator coil 102. If it is determined at step 304 that the temperature of the evaporator coil 102 is above the freeze temperature, the process 300 proceeds to step 306. However, if it is determined at step 304 that the temperature of the evaporator coil 102 is below the freeze temperature, the process 300 proceeds to step 312.

At step 306, a no-frost timer is started and the process 300 proceeds to step 308. At step 308, the controller 122 determines if a heating demand for the enclosed space 101 has been met. If it is determined at step 308 that the heating demand has been met, the process 300 proceeds to step 310, where the heat pump system 100 ceases operation and the process 300 ends. However, if it is determined at step 308 that the heating demand has not been met, the process 300 returns to step 304.

At step 312, the controller 122 determines whether the temperature of the evaporator coil 102 is greater than the current dew point temperature. In a typical embodiment, information regarding the current dew point temperature is received from the external data source 150. In some embodiments, the current dew point temperature is calculated using information from the external data source 150 or the first sensor 160 and the second sensor 162. If it is determined that the current dew point temperature is less than the temperature of the evaporator coil 102, no frost can form on the evaporator coil 102 and the process 300 proceeds to step 306. However, if it is determined that the current dew point temperature is greater than the temperature of the evaporator coil 102, frost can form on the evaporator coil 102 and the process 300 proceeds to step 314.

At step 314, a frost timer is started and the controller 122 calculates several values before proceeding on to step 316. In a typical embodiment, the controller 122 calculates the following values: 1) a mass flow rate of air that is being blown over the evaporator coil 102 by the exterior fan 130; 2) an amount of moisture in the air at a present exterior temperature; 3) an amount of moisture in the air at an apparatus dew point temperature of the evaporator coil 102; and 4) a frost-collection rate. The mass flow rate of air can be determined based upon a speed at which the exterior fan 130 is blowing. The speed of the exterior fan 130 can be determined using a sensor associated with the exterior fan 130 or can be determined based upon the speed of the compressor 108 as discussed above. Knowing the speed of the exterior fan 130 allows the CFM of air that the exterior fan 130 moves over the evaporator coil 102 to be calculated. In a typical embodiment, the CFM of the exterior fan 130 is a performance property of the exterior fan 130 that is known. The mass of the air being blown over the evaporator coil 102 can then be calculated by multiplying the CFM by the density of air. The density of air is determined based upon the present exterior air conditions. In particular, the density of air is a function of the ambient temperature, the relative humidity, and the altitude.

In a typical embodiment, the amount of moisture in the air at the present exterior temperature is a constant for a particular exterior temperature and relative humidity. In a typical embodiment, a table of values of the grains of moisture per pound of air based on various outdoor temperatures and relative humidities can be stored in the memory 128 of the controller 122. In a typical embodiment, the controller 122 obtains the present exterior temperature and relative humidity from the external data source 150. In some embodiments, the controller 122 obtains the present exterior temperature from the first sensor 160. Once the controller 122 has obtained the present exterior temperature and the relative humidity, the controller 122 may reference the table of values of grains of moisture per pound of air to determine the amount of moisture in the air at the present conditions.

In a typical embodiment, an amount of moisture in the air at an apparatus dew point temperature of the evaporator coil 102 is a constant for a particular temperature. In a typical embodiment, the table of values of grains of moisture per pound of air at various temperatures and relative humidities can be referenced by the controller 122 to determine the amount of moisture in the air at the present apparatus dew point temperature of the evaporator coil 102. In a typical embodiment, the controller 122 obtains the present apparatus dew point temperature of the evaporator coil 102 from the second sensor 162 and the relative humidity from the external data source 150. In some embodiments, the controller 122 may obtain the present apparatus dew point temperature of the evaporator coil 102 by measuring a temperature of refrigerant within the evaporator coil 102. Once the controller 122 has obtained the present exterior temperature and the relative humidity, the controller 122 may reference the table of values of grains of moisture per pound of air to determine the amount of moisture in the air at the present apparatus dew point temperature of the evaporator coil 102.

For the purposes of calculating the amount of moisture in the air at the present apparatus dew point temperature it is assumed that the air flowing over the evaporator coil 102 is cooled to a temperature equal to the temperature of the evaporator coil 102. As the air flowing over the evaporator coil 102 is cooled, an ability of the air flowing over the evaporator coil 102 to retain moisture is reduced. As a result of this reduction, moisture settles out of the air and onto the evaporator coil 102.

In a typical embodiment, the frost-collection rate describes a theoretical maximum rate at which frost can begin to form on the evaporator coil 102 given the current environmental conditions in which the heat pump system 100 is operating. The frost-collection rate is calculated by subtracting the amount of moisture in the air at an apparatus dew point temperature from the amount of moisture in the air at the present exterior temperature and multiplying the result by the mass flow rate of air. In some embodiments, the controller 122 adjusts the frost-collection rate with a correction factor. It is acknowledged that the air flowing over the evaporator coil 102 is not cooled to the same temperature as the evaporator coil 102 due to various inefficiencies relating to a transfer of heat between the evaporator coil 102 and the air flowing over the evaporator coil 102. In order to account for this difference, a correction factor may be used to more closely reflect an actual amount of moisture that settles on the evaporator coil 102. For example, the calculated frost-collection rate may be multiplied by the correction factor to more accurately reflect an actual amount of moisture that settles on the evaporator coil 102. After the calculations of step 314 have been determined, the process 300 proceeds to step 316.

At step 316, the controller 122 determines if the frost-collection rate is greater than a frost-collection-rate threshold. The frost-collection-rate threshold is a value that can be set as desired. Higher values for the frost-collection-rate threshold allow the heat pump system 100 to continue to operate for longer periods of time before a defrost cycle is initiated. However, as frost that accumulates on the evaporator coil 102, an ability of the heat pump system 100 to heat the enclosed space 101 decreases. Lower values for the frost-collection-rate threshold helps prevent large amounts of frost from forming on the evaporator coil 102 because defrost cycles will occur more often. However, running defrost cycles more often requires that the heating element 133 be used more often, which negates efficiencies and cost savings regarding the providing of heat to the enclosed space 101 compared to heating the enclosed space 101 in the heat pump mode. If it is determined at step 316 that the frost-collection rate is greater than the frost-collection-rate threshold, the process 300 proceeds to step 320. However, if it is determined that the frost-collection rate is less than the frost-collection-rate threshold, the process 300 proceeds to step 318.

At step 318, the controller 122 calculates the weight of frost that has formed on the evaporator coil 102 and compares the weight of that the frost that has formed to a frost-weight threshold. The frost-weight threshold is a value that can be set as desired. Higher values for the frost-weight threshold allow the heat pump system 100 to continue to operate for longer periods of time before a defrost cycle is initiated. However, as frost that accumulates on the evaporator coil 102, an ability of the heat pump system 100 to heat the enclosed space 101 decreases. Lower values for the frost-weight threshold helps prevent large amounts of frost from forming on the evaporator coil 102 because defrost cycles will occur more often. However, running defrost cycles more often requires that the heating element 133 be used more often, which negates efficiencies and cost savings regarding the providing of heat to the enclosed space 101 compared to heating the enclosed space 101 in the heat pump mode. If it is determined at step 318 that the frost weight is greater than the frost-weight threshold, the process 300 proceeds to step 320. However, if it is determined that the frost weight is less than the frost-weight threshold, the process 300 returns to step 316.

At step 320, the controller 122 initiates a defrost cycle. As discussed above, in order to defrost the evaporator coil 102, the controller 122: changes the reversing valve 104 to the configuration of reversing valve 104*a;* closes the first bypass valve 114; opens the first throttling valve 116; opens the second bypass valve 118; closes the second throttling valve 120; and activates the heating element 133. After the defrost cycle has begun, the process 300 proceeds to step 322.

At step 322, the controller 122 determines if the temperature of the evaporator coil 102 is greater than a thawing-temperature threshold. The thawing-temperature threshold is a value that can be set as desired. In a typical embodiment, the thawing-temperature threshold is set at value well above the freeze temperature. For example, the thawing-temperature threshold may be set at 60° F. In other embodiments, the thawing-temperature threshold may be set to other temperatures as desired. In general, higher thawing-temperature threshold values cause the defrost cycle to run for longer periods of time and lower thawing-temperature threshold values cause the defrost cycle to run for shorter periods of time. If it is determined at step 322 that the temperature of the evaporator coil 102 is less than the thawing-temperature threshold, the process 300 returns to step 320. However, if it is determined at step 322 that the temperature of the evaporator coil 102 is greater than the thawing-temperature threshold, the process 300 proceeds to step 324. At step 324, the defrost cycle ends. After step 324, the process 300 returns to step 302.

The process 300 described above may be modified to satisfy various design parameters. For example, steps may be removed, added, or changed. In some embodiments, the process 300 may evaluate weather-forecast data. For example, the controller 122 may receive weather-forecast data from the external data source 150 that informs the controller 122 about future weather conditions. Information regarding future weather conditions may be relevant to the decision regarding whether a defrost cycle should be initiated. For example, once the process 300 reaches step 314, the controller 122 could include an additional step that is carried out before the step 314 that considers the weather-forecast data. If the weather-forecast data includes a forecast that the ambient temperature will rise above freezing in the near future, the controller 122 can decide not to initiate the defrost cycle and instead proceed to back to step 302. Initiating a defrost cycle when the forecast indicates that the ambient temperature will be above freezing in the near future is unnecessary because frost that has formed on the evaporator coil 102 will begin to melt due to ambient temperature being above freezing.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

While the above detailed description has shown, described, and pointed out novel features as applied to various embodiments, it will be understood that various omissions, substitutions, and changes in the form and details of the devices or algorithms illustrated can be made without departing from the spirit of the disclosure. As will be recognized, the processes described herein can be embodied within a form that does not provide all of the features and benefits set forth herein, as some features can be used or practiced separately from others. The scope of protection is defined by the appended claims rather than by the foregoing description. All changes which come within the meaning and range of equivalency of the claims are to be embraced within their scope.

What is claimed is:

1. A method of initiating a defrost cycle using a controller of a heat pump system, the method comprising:

measuring a temperature of an evaporator coil;

determining a present temperature of ambient air that surrounds the evaporator coil;

determining a current dew point temperature of the ambient air;

determining whether the temperature of the evaporator coil is less than the freezing temperature of the water vapor in the ambient air;

responsive to a determination that the temperature of the evaporator coil is less than the freezing temperature, determining whether the dew point temperature of the ambient air is greater than the temperature of the evaporator coil;

responsive to a determination that the dew point temperature of the ambient air is greater than the temperature of the evaporator coil, calculating a frost-collection rate, wherein the calculating the frost-collection rate comprises:

calculating a mass flow rate of air blown over the evaporator coil;

calculating an amount of moisture in the ambient air at the present temperature of the ambient air;

calculating an amount of moisture in the ambient air at the dew point temperature of the ambient air; and subtracting the amount of moisture in the ambient air at the dew point temperature from the amount of moisture in the ambient air at the present temperature of the ambient air and multiplying by the mass flow rate of air blown over the evaporator coil;

determining whether the frost-collection rate is greater than a frost-collection-rate threshold; and responsive to a determination that the frost-collection rate is greater than the frost-collection-rate threshold, initiating the defrost cycle.

2. The method of claim 1, comprising:

responsive to a determination that the frost-collection rate is less than the frost-collection-rate threshold, calculating the weight of frost that has formed on the evaporator coil;

determining whether the weight of frost that has formed on the evaporator coil is greater than a frost-weight threshold; and responsive to a determination that the weight of frost that has formed on the evaporator coil is greater than the frost-weight threshold, initiating the defrost cycle.

3. The method of claim 2, comprising responsive to a determination that the weight of frost that has formed on the evaporator coil is less than the frost-weight threshold, re-calculating the frost-collection rate.

4. The method of claim 1, comprising:

responsive to a determination that the temperature of the evaporator coil is greater than the freezing temperature, determining whether a heating demand has been met;

responsive to a determination that the heating demand has been met, terminating operating of the heat pump system; and responsive to a determination that the heating demand has not been met, re-determining whether the temperature of the evaporator coil is less than the freezing temperature.

5. The method of claim 1, comprising:

responsive to a determination that the dew point temperature is less than the temperature of the evaporator coil, determining whether a heating demand has been met;

responsive to a determination that the heating demand has been met, terminating operation of the heat pump system; and responsive to a determination that the heating demand has not been met, re-determining whether the temperature of the evaporator coil is less than the freezing temperature.

6. The method of claim 1, comprising:

responsive to initiating the defrost cycle, determining whether the temperature of the evaporator coil has risen to a temperature greater than a thawing-temperature threshold;

responsive to a determination that the temperature of the evaporator coil is greater than the thawing-temperature threshold, ending the defrost cycle; and responsive to a determination that the temperature of the evaporator coil remains less than the thawing-temperature threshold, continuing the defrost cycle.

7. The method of claim 1, wherein the controller receives data from a data source external to the heat pump system.

8. The method of claim 7, wherein the data source external to the heat pump system is an internet weather-data source.

9. The method of claim 7, wherein the controller calculates the dew point temperature using the data received from the data source external to the heat pump system.

10. The method of claim 1, wherein the controller calculates the dew point temperature of air using data received from at least one sensor, wherein the at least one sensor is positioned to monitor environmental conditions of the evaporator coil.

11. The method of claim 1, wherein calculating the frost-collection rate comprises adjusting the frost-collection rate with a correction factor.

12. A controller for initiating a defrost cycle of a heat pump system, the controller configured to:

measure a temperature of an evaporator coil;

determine a present temperature of ambient air that surrounds the evaporator coil;

determine a current dew point temperature of the ambient air;

determine whether the temperature of the evaporator coil is less than the freezing temperature of the water vapor in the ambient air;

responsive to a determination that the temperature of the evaporator coil is less than the freezing temperature of the water vapor in the ambient air, determine whether the dew point temperature of the ambient air is greater than the temperature of the evaporator coil;

responsive to a determination that the dew point temperature of the ambient air is greater than the temperature of the evaporator coil, calculate a frost-collection rate, wherein to calculate the frost-collection rate, the controller is configured to:

calculate a mass flow rate of air blown over the evaporator coil;

calculate an amount of moisture in the ambient air at the present temperature of the ambient air;

calculate an amount of moisture in the ambient air at the dew point temperature of the ambient air; and subtract the amount of moisture in the ambient air at the dew point temperature from the amount of moisture in the ambient air at the present temperature of the ambient air and multiply by the mass flow rate of air blown over the evaporator coil; and determine if the frost-collection rate is greater than a frost-collection rate threshold; and responsive to a determination that the frost-collection rate is greater than the frost-collection rate threshold, initiate the defrost cycle.

13. The controller of claim 12, wherein the controller is configured to:

responsive to a determination that the frost-collection rate is less than the frost-collection rate threshold, calculate the weight of frost that has formed on the evaporator coil;

responsive to calculating the weight of frost that has formed on the evaporator coil, determine whether the weight of frost that has formed on the evaporator coil is greater than a frost-weight threshold; and responsive to determination that the weight of frost that has formed on the evaporator coil is greater than the frost-weight threshold, initiate the defrost cycle.

14. The controller of claim 13, comprising responsive to a determination that the weight of frost that has formed on the evaporator coil is less than the frost-weight threshold, re-calculating the frost-collection rate.

15. The controller of claim 12, comprising:

responsive to a determination that the temperature of the evaporator coil is greater than the freezing temperature, determine whether a heating demand has been met;

responsive to a determination that the heating demand has been met, terminate operation of the heat pump system; and responsive to a determination that the heating demand has not been met, re-determine whether the temperature of the evaporator coil is less than the freezing temperature.

16. The controller of claim 12, comprising:

responsive to a determination that the dew point temperature is less than the temperature of the evaporator coil, determine whether a heating demand has been met;

responsive to a determination that the heating demand has been met, terminate operation of the heat pump system; and responsive to a determination that the heating demand has not been met, re-determine whether the temperature of the evaporator coil is less than the freezing temperature.

17. The controller of claim 12, comprising:

responsive to initiating the defrost cycle, determining whether the temperature of the evaporator coil has risen to a temperature greater than a thawing-temperature threshold;

responsive to a determination that the temperature of the evaporator coil is greater than the thawing-temperature threshold, ending the defrost cycle; and responsive to a determination that the temperature of the evaporator coil remains less than the thawing-temperature threshold, continuing the defrost cycle.

18. The controller of claim 12, wherein the controller is configured to receive data from a data source external to the heat pump system.

19. The controller of claim 18, wherein the data source external to the heat pump system is an internet weather-data source.

20. The controller of claim 18, wherein the controller is configured to calculate the dew point temperature using data received from the data source external to the heat pump system.

21. The controller of claim 12, wherein the controller is configured to calculate the dew point temperature using data received from at least one sensor, wherein the at least one sensor is positioned to monitor environmental conditions of the evaporator coil.

22. The controller of claim 12, wherein calculating the frost-collection rate comprises adjusting the frost-collection rate with a correction factor.

23. A heat pump system comprising:

an evaporator coil;

a condenser coil coupled to the evaporator coil to permit a fluid to cycle between the evaporator coil and the condenser coil;

a compressor coupled between the evaporator coil and the condenser coil;

a reversing valve configured to reverse a direction of flow of the fluid through the heat pump system; and a controller for initiating a defrost cycle of the heat pump system, the controller configured to:

measure a temperature of the evaporator coil;

determine a present temperature of ambient air that surrounds the evaporator coil;

determine a current dew point temperature of the ambient air;

determine whether the temperature of the evaporator coil is less than the freezing temperature of the water vapor in the ambient air;

responsive to a determination that the temperature of the evaporator coil is less than the freezing temperature of the water vapor in the ambient air, determine whether the dew point temperature is greater than the temperature of the evaporator coil;

responsive to a determination that the dew point temperature of the ambient air is greater than the temperature of the evaporator coil, calculate a frost-collection rate, wherein to calculate the frost-collection rate, the controller is configured to:

calculate a mass flow rate of air blown over the evaporator coil;

calculate an amount of moisture in the ambient air at the present temperature of the ambient air;

calculate an amount of moisture in the ambient air at the dew point temperature of the ambient air; and subtract the amount of moisture in the ambient air at the dew point temperature from the amount of moisture in the ambient air at the present temperature of the ambient air and multiply by the mass flow rate of air blown over the evaporator coil;

determine whether the frost-collection rate is greater than a frost-collection rate threshold;

responsive to a determination that the frost-collection rate is greater than the frost-collection rate threshold, initiate a defrost cycle;

responsive to a determination that the frost-collection rate is less than a frost-collection rate threshold, calculate the weight of frost that has formed on the evaporator coil;

responsive to a calculation of the weight of frost that has formed on the evaporator coil, determine whether the weight of frost that has formed on the evaporator coil is greater than a frost-weight threshold; and responsive to a determination that the weight of frost that has formed on the evaporator coil is greater than the frost-weight threshold, initiate the defrost cycle.

* * * * *